US005431801A

United States Patent [19]

Nishimura et al.

[11] Patent Number: 5,431,801

[45] Date of Patent: Jul. 11, 1995

[54] ELECTROPLATING METHOD AND APPARATUS

[75] Inventors: Seiya Nishimura; Yoshihisa Maejima; Tokuyoshi Ohta, all of Shizuoka, Japan

[73] Assignee: Yamaha Corporation, Japan

[21] Appl. No.: 192,722

[22] Filed: Feb. 7, 1994

[30] Foreign Application Priority Data

Feb. 12, 1993 [JP] Japan ..... 5-024529

[51] Int. Cl.[6] ..... C25D 17/06; C25D 21/04

[52] U.S. Cl. ..... 205/88; 204/237; 204/277; 204/278

[58] Field of Search ..... 204/277-278, 204/246-247, 237; 205/88

[56] References Cited

U.S. PATENT DOCUMENTS

| | | | |
|---|---|---|---|
| 1,786,398 | 12/1930 | Fink et al. | 204/278 X |
| 2,439,491 | 4/1948 | Schiffl | 204/277 |
| 2,465,747 | 3/1949 | Pessel | 204/278 |
| 4,592,819 | 6/1986 | Suzuki et al. | 204/237 |
| 4,670,121 | 6/1987 | Ginatta et al. | 204/246 X |
| 5,104,496 | 4/1992 | Dupree | 204/278 X |

*Primary Examiner*—Donald R. Valentine

*Attorney, Agent, or Firm*—Ostrolenk, Faber, Gerb & Soffen

[57] ABSTRACT

An electroplating apparatus positively biases an anode with respect to a work dipped in an electrolyte in an electrolysis vessel for depositing metal on the work, and an inert ambience is created over the electrolyte so that the electrolyte is never oxidized.

6 Claims, 3 Drawing Sheets

ELECTROPLATING METHOD AND APPARATUS

FIELD OF THE INVENTION

This invention relates to electroplating and, more particularly, to an electroplating apparatus and a method using the same.

DESCRIPTION OF THE RELATED ART

A typical example of the electroplating apparatus is illustrated in FIG. 1 of the drawings, and comprises an electrolysis vessel 1 for electrolyte 2, an anode 3 dipped in the electrolyte 2, a retainer 4 for supporting the anode 3 and a supporting mechanism 5 for keeping a work 6 in spaced relation to the anode 3 in the electrolyte 2. The electrolysis vessel 1 is open to the air, and the electrolyte 2 is exposed to the oxygen contained in the air.

The prior art electroplating apparatus further has an electric power source 7, and the electric power source 7 positively biases the anode 3 with respect to the work 6. While direct current is flowing through the electrolyte 2 between the anode 3 and the work 6, metal ions in the electrolyte 2 is deionized at the work 6, and the work 6 is coated with the metal.

The prior art electroplating apparatus encounters a problem in that oxides are mixed in the metal film coating the work 6, and the metal film is not high in purity.

SUMMARY OF THE INVENTION

It is therefore an important object of the present invention to provide an electroplating apparatus which can deposit a pure metal film on a work.

It is also an important object of the present invention to provide a method of electroplating for depositing a pure metal film.

The present inventors contemplated the problems, and found that the oxides were produced from the contents of the electrolyte 2 through oxidation with the air.

To accomplish the object, the present invention proposes to create an inert ambience around the electrolyte.

In accordance with one aspect of the present invention, there is provided an electroplating apparatus for depositing a metal film on a work, comprising: a) an electrolysis vessel having an opening, and keeping an electrolyte containing an ionized metal; b) an anode dipped in the electrolyte; c) a conductive retainer for keeping the work in the electrolyte in spaced relation to the anode; d) an electric power source connected with the anode and the conductive retainer, and positively biasing the anode with respect to the work; e) a cap member closing the opening, and forming an inner space together with the electrolyte in the electrolysis vessel; and f) means for creating an inert ambience in the inner space.

The means may have a seal member provided between the electrolysis vessel and the cap for sealing the inner space, a source of an inert gas connected with the inner space for supplying the inert gas thereto, and an evacuating means connected with the inner space for creating a vacuum ambience in the inner space.

The means may have a blowing unit for blowing an inert gas into the inner space, and an exhaust for allowing gas to escape from the inner space to the atmosphere.

In accordance with another aspect of the present invention, there is provided a method of electroplating, for depositing a metal on a work, comprising the steps of: a) preparing an electroplating apparatus having an electrolysis vessel having an opening and keeping an electrolyte containing an ionized metal, an anode dipped in the electrolyte, a conductive retainer for keeping the work, an electric power source connected with the anode and the conductive retainer, a cap member closing the opening for forming an inner space together with the electrolyte in the electrolysis vessel, means for creating an inert ambience in the inner space; b) putting the work into the inner space through the opening; c) causing the retainer to keep the work in the electrolyte in spacing relation to the anode; d) closing the opening with the cap; e) creating an inert ambience in the inner space between the electrolyte and the cap; and f) positively biasing the anode with respect to the work for depositing the metal on the work.

BRIEF DESCRIPTION OF THE DRAWINGS

The features and advantages of the electroplating apparatus and the method according to the present invention will be more clearly understood from the following description taken in conjunction with the accompanying drawings in which.

DESCRIPTION OF THE PREFERRED EMBODIMENTS

First Embodiment

Figure 1:
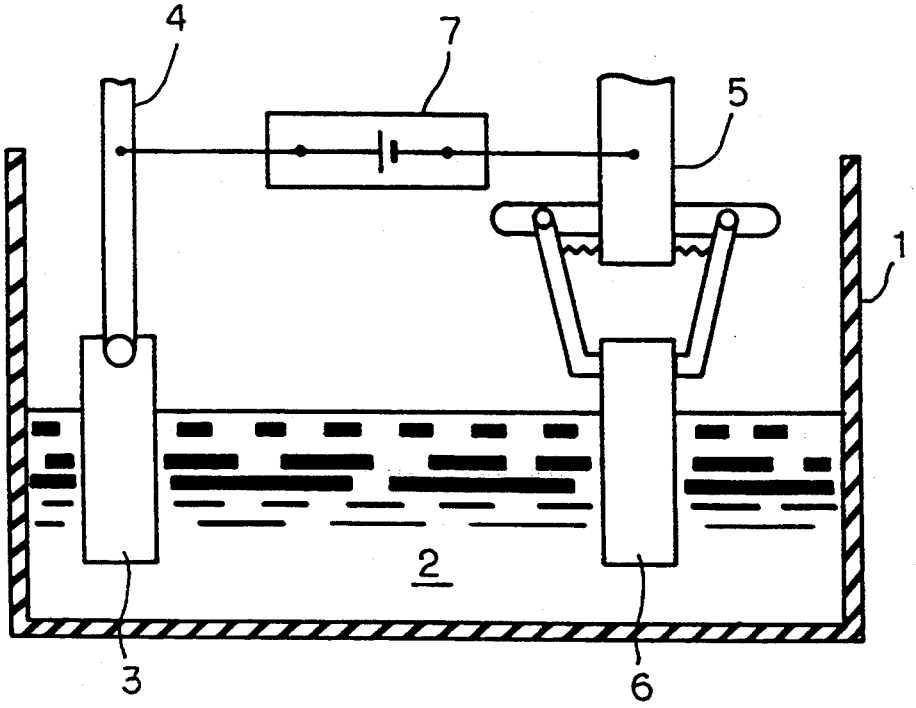
Fig. 1 PRIOR ART
FIG. 1 is a cross-sectional view showing the prior art electroplating apparatus.
Figure 2:
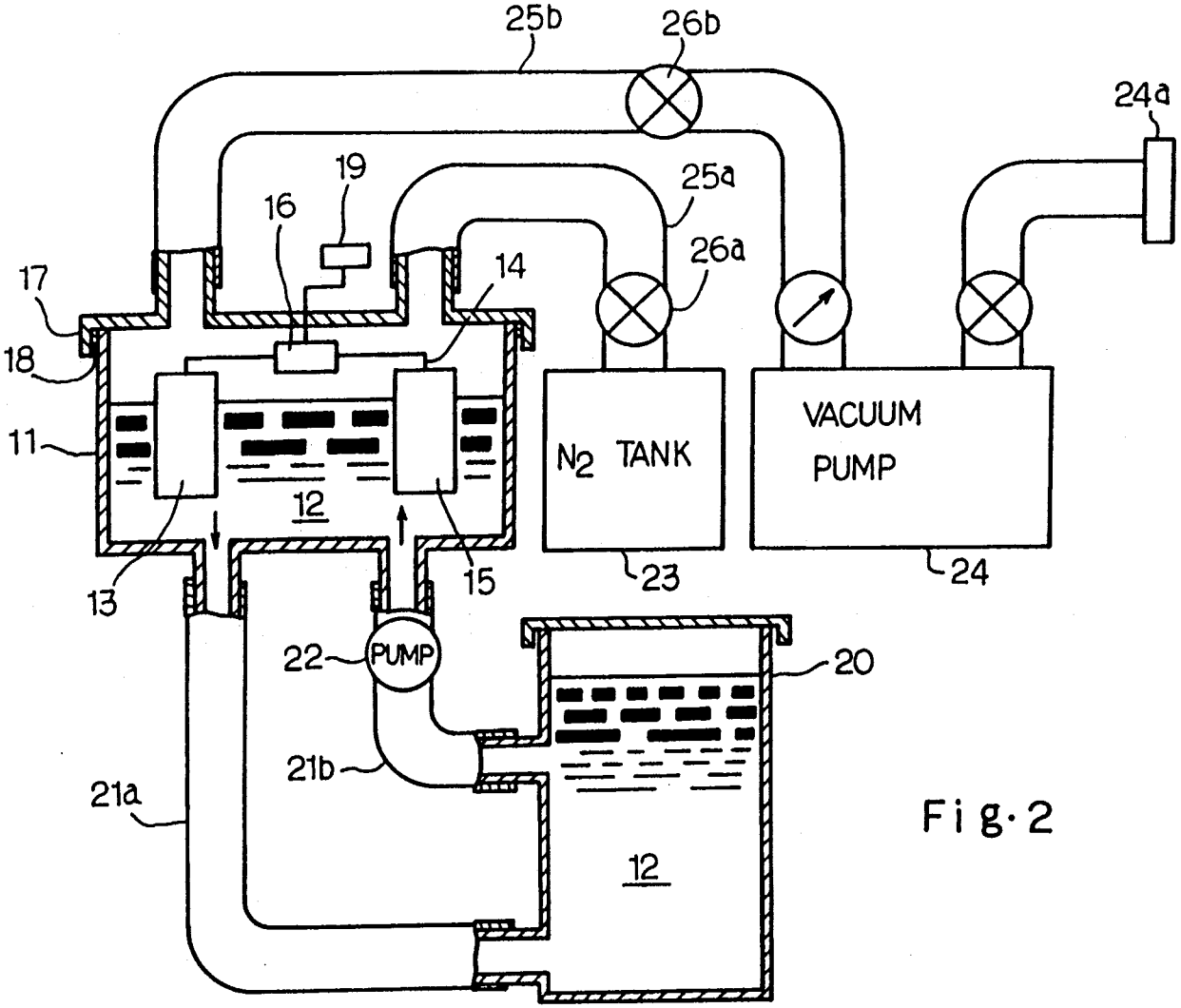
FIG. 2 is a partially cut-away side view showing an electroplating apparatus according to the present invention.

Referring to FIG. 2 of the drawings, an electroplating apparatus embodying the present invention comprises an electrolysis vessel 11 for electrolyte 12 containing metal ions, an anode 13, a retainer 14 for keeping a work 15 in the electrolyte 12 in spacing relation to the anode 13, and an electric power source 16 connected at a positive electrode with the anode and at a negative electrode with the work 15. The electric power source 16 positively biases the anode 13 with respect to the work 15, and direct current flows through the electrolyte 12 between the anode 13 and the work 15. The electrolysis vessel 11 is open at the upper end thereof, and the anode 13 and the work 15 can be taken out from the opening. In this instance, the electric power source 16 is implemented by a direct current source. However, a rectifier is available for the electric power source.

The electroplating apparatus embodying the present invention further comprises a cap 17 for closing the electrolysis vessel 11 and a seal member 18 provided between the electrolysis vessel 11 and the cap 17, and the electrolysis vessel 11 and the cap 17 form an inner space between the electrolyte 12 and the cap 17. The seal member 18 seals the inner space, and the atmosphere can not break the seal. The seal member 18 may be implemented by an elastic O-ring attached to one of the inner surfaces of the cap 17 and the outer surface of the electrolysis vessel 11.

The electroplating apparatus embodying the present invention further comprises a switching unit I 9 electrically connected with the electric power source 16, and the switching unit 19 is provided outside the electrolysis vessel 11. Therefore, an operator manipulates the switching unit 19, and the electroplating is controlled from the outside.

The electroplating apparatus embodying the present invention further comprises a reservoir tank 20, and the reservoir tank 20 holds the electrolyte 12. Two holes are formed in the bottom plate of the electrolysis vessel 11, and the side wall of the reservoir tank 20 also has two holes. The two holes in the bottom plate are respectively connected through pipes 21*a* and 21*b* with the two holes of the side wall, and a pump unit 22 is provided in the pipe 21*b*. The pump unit 22 forces the electrolyte 12 in the reservoir tank 20 to flow into the electrolysis vessel 11, and the electrolyte 12 returns through the pipe 21*a* to the reservoir tank 20. Thus, the electrolyte 12 is circulated between the reservoir tank 20 and the electrolysis vessel 11.

The electroplating apparatus embodying the present invention further comprise a nitrogen tank for nitrogen gas and a vacuum pump unit 24 with an exhaust 24*a*. Two holes are formed in the cap 17, and one of the two holes of the cap 17 is connected through a pipe 25*a* and a valve unit 26*a* with the nitrogen tank 23. The nitrogen tank 23 supplies nitrogen gas into the inner space between the electrolyte 12 and the cap 17. The other of the two holes is connected through a pipe 25*b* and a valve unit 26*b* with the inlet of the vacuum pump unit 24, and the air is evacuated through the pipe 25*b* by means of the vacuum pump unit 24.

In this instance, the seal member 18, the vacuum pump unit 24, the nitrogen tank 23, the pipes 25*a* and 25*b* and the valve units 26*a* and 26*b* as a whole constitute a means for creating an inert ambience:

Using the electroplating apparatus thus arranged, an electroplating sequence is carried out as follows. First, the cap 17 is removed from the electrolysis vessel 11, and an operator attaches the work 15 to the retaining mechanism 14. The retaining mechanism 14 keeps the work 15 in the electrolyte 12 in spacing relation to the anode 13, and the cap I 7 closes the opening in such a manner that the seal member 18 seals the inner space.

The valve unit 26*a* is opened, and the vacuum pump unit 24 starts to evacuate the inner space. When an appropriate vacuum ambience is created, the valve 26*b* is closed.

Subsequently, the valve unit 26*a* is opened, and the nitrogen gas flows from the nitrogen tank 23 into the inner space. As a result, the inner space is filled with the nitrogen gas, and is isolated from the atmosphere.

The pump unit 22 causes the electrolyte 12 to circulate, and a heater unit (not shown) keeps the temperature electrolyte 12 at around 50 degrees in centigrade.

The operator manipulates the switching unit 19, and the electric power source 16 positively biases the anode 13 with respect to the work 15. Then, direct current flows through the electrolyte 12 between the anode 13 and the work 15, and the metal ions are deionized around the work 15. As a result, the deionized metal is deposited on the work 15 and the work 15 is coated with a metal film.

As will be appreciated from the foregoing description, the electroplating apparatus and the method according to the present invention carry out the electroplating on the work 15 in the electrolyte 12 sealed with the inert gas, and the inert gas prevents the electrolyte 12 from oxidizing. Therefore, undesirable oxides are not produced in the electrolyte 12, and, accordingly, are not mixed in the metal film deposited on the work 15.

Second Embodiment

Figure 3:
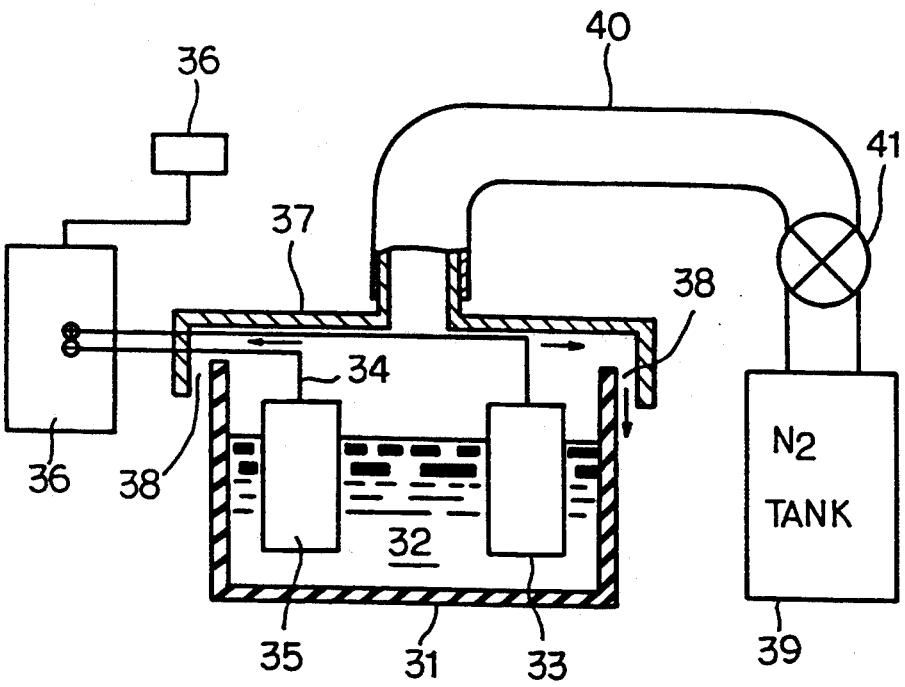
FIG. 3 is a partially cut-away side view showing another electroplating apparatus according to the present invention.

Turning to FIG. 3 of the drawings, another electroplating apparatus embodying the present invention largely comprises an electrolysis vessel 31 for electrolyte 32, an anode 33, a conductive retaining mechanism 34 for a work 35, an electric power source 36 connected at a positive electrode with the anode 33 and at a negative electrode with the conductive retaining mechanism 34, and a switching unit 36 for positively biasing the anode 33 with respect to the work 35. These component members 31 to 36 are similar to corresponding components of the first embodiment, and no further description is incorporated hereinbelow for the sake of simplicity.

The second embodiment of the electroplating apparatus of the present invention further comprises a cap 37 closing an opening of the electrolysis vessel 31, and an exhaust opening 38 is formed between the electrolysis vessel 31 and the cap 37.

The electroplating apparatus embodying the present invention further comprises a nitrogen gas tank 39 for high-pressure nitrogen gas, a pipe 40 connecting an outlet nozzle of the nitrogen gas tank 39 with an opening formed in the cap 37, and a valve unit 41 inserted in the pipe 40. The nitrogen gas tank 39, the pipe 40 and the valve unit 41 as a whole constitute a blowing unit, and the blowing unit and the exhaust opening form in combination a means for creating an inert ambience.

In an electroplating sequence using the apparatus shown in FIG. 3, a operator removes the cap 37 from the electrolysis vessel 31, and causes the remaining mechanism 34 to keep the work 34 in the electrolyte 32 in spaced relation to the anode 33.

The cap 37 closes the opening of the electrolysis vessel 31, and the exhaust opening connects the inner space between the cap and the electrolyte 32 to the atmosphere. The valve unit 41 is open, and the high-pressure nitrogen gas is blown into the inner space. As a result, the air in the inner space is evacuated through the exhaust opening 38, and the high-pressure nitrogen gas creates inert ambience in the inner space.

The operator manipulates the switching unit 36, and the direct current flows through the electrolyte between the anode 33 and the work 35. As a result, metal ions in the electrolyte 32 are deionized around the work 35, and a metal film is deposited on the work 35.

The electroplating is carried out in the inert ambience, and the electrolyte 32 is never oxidized. As a result, oxides are not mixed in the metal film deposited on the work 35, and the metal film is high in quality.

Although particular embodiments of the present invention have been shown and described, it will be obvious to those skilled in the art that various changes and modifications may be made without departing from the spirit and scope of the present invention. For example, any inert gas is acceptable, and a filter may be provided in association with the pump unit 22. Moreover, an inert gas recovery system may be provided for the exhaust opening.

What is claimed is:

1. An electroplating apparatus for depositing a metal film on a work, comprising:

a) an electrolysis vessel adapted to hold an electrolyte containing an ionized metal, said vessel having an opening;

b) an anode adapted to be dipped in said electrolyte;

c) a conductive retainer adapted to hold said work in said electrolyte in spaced relation to said anode;

d) an electric power source connected with said anode and said conductive retainer, said power source positively biasing said anode with respect to said work;

e) a cap member for closing said opening, and forming an inner space together with said electrolyte in said electrolysis vessel;

f) means for creating an inert ambience in said inner space;

g) a reservoir tank adapted to hold said electrolyte;

h) a circulating unit disposed between said electrolysis vessel and said reservoir tank for circulating said electrolyte therebetween.

2. The electroplating apparatus as set forth in claim 1, wherein said means for creating an inert ambience comprises:

f-1) a seal member provided between said electrolysis vessel and said cap for sealing said inner space, f-2) a source of an inert gas connecting with said inner space for supplying said inert gas to said inner space, and f-3) an evacuating unit connected with said inner space for creating a vacuum ambience in said inner space.

3. The electroplating apparatus as set forth in claim 1, wherein said means for creating an inert ambience comprises:

f-1) a blowing unit for blowing an inert gas into said inner space, and f-2) an exhaust allowing gas to escape from said inner space to the atmosphere.

4. A method of electroplating for depositing a metal on a work, comprising the steps of:

a) preparing an electroplating apparatus having an electrolysis vessel adapted to hold an electrolyte containing an ionized metal, said vessel having an opening, an anode adapted to be dipped in said electrolyte, a conductive retainer for holding said work, an electric power source connected with said anode and said conductive retainer, a cap member for closing said opening and forming an inner space together with said electrolyte in said electrolysis vessel, means for creating an inert ambience in said inner space, a reservoir tank adapted to hold said electrolyte, and a circulating unit disposed between said electrolysis vessel and said reservoir tank for circulating said electrolyte therebetween;

b) putting said work into said inner space through said opening;

c) causing said retainer to keep said work in said electrolyte in spaced relation to said anode;

d) closing said opening with said cap;

e) creating an inert ambience in said inner space between said cap and said electrolyte; and f) positively biasing said anode with respect to said work for depositing said metal-on said work.

5. The method as set forth in claim 4, wherein said step e) comprises the sub-steps of e-1) sealing a gap between said electrolysis vessel and said cap, e-2) evacuating said inner space, and e-3) introducing an inert gas into said inner space.

6. The method as set forth in claim 5, wherein said inert ambience is created by blowing an inert gas into said inner space for replacing a gas in said inner space with said inert gas.

* * * * *